US012618188B2

(12) United States Patent
Cheon

(10) Patent No.: US 12,618,188 B2
(45) Date of Patent: May 5, 2026

(54) WASHING MACHINE

(71) Applicant: SAMSUNG ELECTRONICS CO., LTD., Suwon-si (KR)

(72) Inventor: Youngseong Cheon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 134 days.

(21) Appl. No.: 18/144,374

(22) Filed: May 8, 2023

(65) Prior Publication Data

US 2023/0272573 A1 Aug. 31, 2023

Related U.S. Application Data

(63) Continuation of application No. PCT/KR2021/020270, filed on Dec. 30, 2021.

(30) Foreign Application Priority Data

Jan. 7, 2021 (KR) ..... 10-2021-0002127
Mar. 18, 2021 (KR) ..... 10-2021-0035227

(51) Int. Cl.
*D06F 39/02* (2006.01)
*D06F 23/04* (2006.01)

(52) U.S. Cl.
CPC ..... *D06F 39/028* (2013.01); *D06F 23/04* (2013.01); *D06F 39/022* (2013.01)

(58) Field of Classification Search
None
See application file for complete search history.

(56) References Cited

U.S. PATENT DOCUMENTS

| | | | |
|---|---|---|---|
| 5,579,656 | A | 12/1996 | Shin |
| 6,826,933 | B2 | 12/2004 | Merkle et al. |
| 7,481,082 | B2 | 1/2009 | Cho et al. |
| 8,783,071 | B2 | 7/2014 | Ko et al. |
| 8,826,700 | B2 | 9/2014 | Kim |
| 9,702,078 | B2 | 7/2017 | Lee |
| 10,508,380 | B2 | 12/2019 | Lee |

(Continued)

FOREIGN PATENT DOCUMENTS

| | | |
|---|---|---|
| CN | 105755753 A | 7/2016 |
| JP | 11-290580 | 10/1999 |

(Continued)

OTHER PUBLICATIONS

International Search Report dated Apr. 28, 2022 in International Patent Application No. PCT/KR2021/020270 (2 pages; 3 pages English translation).

(Continued)

*Primary Examiner* — Cristi J Tate-Sims
(74) *Attorney, Agent, or Firm* — STAAS & HALSEY LLP

(57) ABSTRACT

A washing machine including a cabinet, a tub arrangeable inside the cabinet, and a detergent supply device configured to supply a detergent to the tub, wherein the detergent supply device includes a housing coupleable to the cabinet, a case insertable into the housing or drawn out from the housing, and a detergent container coupleable to and decoupleable from the case such that while the detergent container is coupled to the case, the detergent container is insertable into the housing or drawn out from the housing along with the case.

12 Claims, 12 Drawing Sheets

(56) References Cited

U.S. PATENT DOCUMENTS

| | | | | |
|---|---|---|---|---|
| 10,822,737 | B2 | 11/2020 | Park et al. | |
| 11,384,472 | B2 | 7/2022 | Seo et al. | |
| 2005/0229652 | A1* | 10/2005 | Kim | D06F 39/028 68/237 |
| 2010/0015258 | A1 | 1/2010 | Alberte et al. | |
| 2010/0018258 | A1 | 1/2010 | Cho et al. | |
| 2011/0120196 | A1* | 5/2011 | Kim | D06F 39/02 222/416 |
| 2015/0337480 | A1* | 11/2015 | Lee | D06F 39/028 68/17 R |
| 2016/0194810 | A1 | 7/2016 | Jo et al. | |
| 2020/0370230 | A1* | 11/2020 | Seo | D06F 39/028 |
| 2021/0222347 | A1* | 7/2021 | Jung | D06F 39/028 |

FOREIGN PATENT DOCUMENTS

| | | |
|---|---|---|
| JP | 2017-169772 | 9/2017 |
| JP | 2018-102601 | 7/2018 |
| JP | 7022882 | 2/2022 |
| KR | 0135677 | 4/1996 |
| KR | 1999-0086538 | 12/1999 |
| KR | 10-2001-0018202 | 3/2001 |
| KR | 10-2005-0100553 | 10/2005 |
| KR | 10-1082561 | 11/2011 |
| KR | 10-1375715 | 3/2014 |
| KR | 10-1403957 | 6/2014 |
| KR | 10-2015-0135043 | 12/2015 |
| KR | 10-2019-0108999 | 10/2018 |
| KR | 10-2019-004555 | 5/2019 |
| KR | 10-2080521 | 2/2020 |

OTHER PUBLICATIONS

PCT/ISA/237 dated Apr. 28, 2022 in International Patent Application No. PCT/KR2021/020270 (4 pages).
Korean Office Action dated Jan. 7, 2026 for Korean Application No.

* cited by examiner

WASHING MACHINE

CROSS-REFERENCE TO RELATED APPLICATION

This application is a continuation application, under 35 U.S.C. § 111(a), of international application No. PCT/KR2021/020270, filed on Dec. 30, 2021, which claims priority under 35 U. S. C. § 119 to Korean Patent Application No. 10-2021-0002127, filed Jan. 7, 2021 and Korean Patent Application No. 10-2021-0035227, filed Mar. 18, 2021, the disclosures of which are incorporated herein by reference in their entirety.

BACKGROUND

Field

The present disclosure relates to a washing machine, and more particularly, to a washing machine having a detergent supply device.

Discussion of Related Art

In general, a washing machine is an apparatus for washing laundry by rotating a cylindrical drum containing the laundry and water in a tub, and as types of such washing machines there are a drum-type washing machine in which laundry is washed by falling down after being lifted upward along an inner circumferential surface of a drum when the drum, which is disposed substantially horizontally, rotates in forward and reverse directions about a horizontal axis, and a pulsator-type washing machine in which laundry is washed using a water current generated by a pulsator disposed inside a drum when the drum, which is disposed substantially vertically, rotates in forward and reverse directions about a vertical axis.

A detergent supply device in which a detergent is dissolved using water to be supplied to the inside of a tub from an external water supply source and the water mixed with the detergent is supplied to the inside of the tub is installed in an upper side of the drum-type washing machine or the pulsator-type washing machine. The detergent supply device may mix powder detergent in the form of fine particles and/or liquid detergent with water and supply the mixed water to the inside of the tub.

SUMMARY

An aspect of the present disclosure provides a washing machine including a cabinet, a tub arrangeable inside the cabinet, and a detergent supply device configured to supply a detergent to the tub, wherein the detergent supply device includes a housing coupleable to the cabinet, a case insertable into the housing or drawn out from the housing, and a detergent container coupleable to and decoupleable from the case such that while the detergent container is coupled to the case, the detergent container is insertable into the housing or drawn out from the housing along with the case.

The detergent supply device may include a stirring device coupleable to the detergent container such that the stirring device is rotatable while coupled to the detergent container.

The detergent container may include a siphon tube to which the stirring device is coupleable such that the stirring device is rotatable while coupled to the siphon tube, the siphon tube forms a flow path to discharge water from the detergent container together with the stirring device.

The siphon tube may have a height lower than a side wall of the detergent container.

A bottom surface of the detergent container may have a portion inclined downward toward the siphon tube.

The stirring device may be rotatable by water supplied to the detergent supply device.

The detergent supply device may include a nozzle device to supply water from a rear of the case toward a front of the case.

The nozzle device may include a washing water inlet hole into which water is introduced, an air inlet hole into which air is introduced, and a nozzle outlet to guide the water introduced through the washing water inlet hole to an inside of the case.

The nozzle device may be disposed to be spaced apart from a center of a rear wall of the case to one side.

The case may include a case outlet to discharge the detergent from the detergent supply device, the case outlet being positioned on one side of the rear of the case, and the nozzle device may be positioned on another side opposite to the one side of the rear of the case where the case outlet is positioned.

The detergent container may include a guide rib protruding from an outer surface thereof to be supported by an inner wall of the case while the detergent container is coupled to the case.

The case may include a case outlet communicating with the tub and a case bottom surface formed to be inclined downward toward the case outlet, and the detergent container may include guide protrusions protruding toward the case bottom surface of the case to be supported on the case bottom surface of the case and having different lengths.

The guide protrusions may include a first guide protrusion and a second guide protrusion positioned at a rear of the first guide protrusion and formed to be longer than the first guide protrusion.

The case may include a detergent containing space to contain the detergent or to seat the detergent container.

The case may include a detergent containing space and a softener containing space separated from the detergent containing space, and the detergent container may be coupleable to and decoupleable from the detergent containing space.

Another aspect of the present disclosure provides a washing machine including a cabinet, a tub arrangeable inside the cabinet, and a detergent supply device configured to supply a detergent to the tub, wherein the detergent supply device includes a housing coupleable to the cabinet, a case insertable into the housing or drawn out from the housing, a nozzle device disposed to supply water from a rear of the case toward a front of the case, a detergent container coupleable to and decoupleable from in the case, and a stirring device coupleable to the detergent container such that the stirring device is rotatable while coupled to the detergent container.

The detergent container may include a guide rib protruding from an outer surface thereof to be supported by an inner wall of the case when the detergent container is mounted on the case.

The case may include a case outlet communicating with the tub and a bottom surface formed to be inclined downward toward the case outlet, and the detergent container may include guide protrusions protruding toward the bottom surface of the case to be supported on the bottom surface of the case and having different lengths.

The detergent container may include a siphon tube to which the stirring device is rotatably coupled and forming a flow path for discharging water from the detergent container together with the stirring device.

The nozzle device may include a washing water inlet hole into which water is introduced, an air inlet hole into which air is introduced, and a nozzle outlet provided to guide the water introduced through the washing water inlet hole to the inside of the case.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
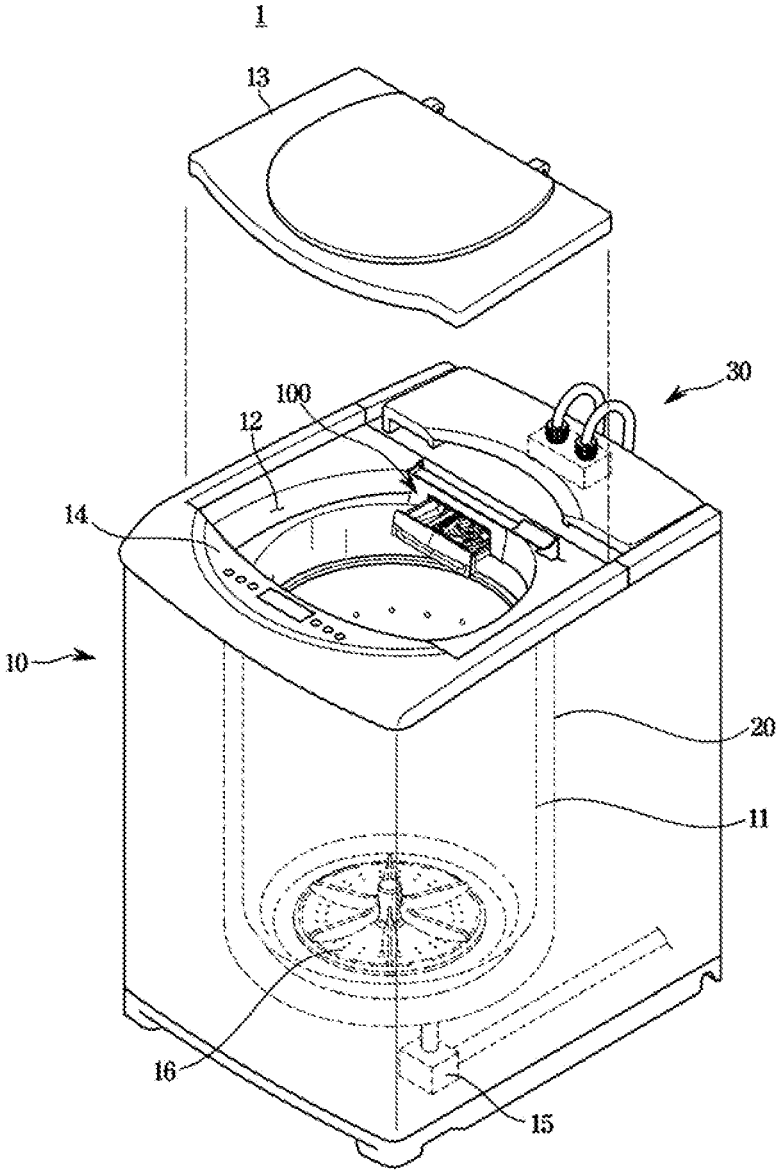
FIG. 1 is a view illustrating a washing machine according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms, and these terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

The present disclosure is directed to providing a washing machine capable of preventing a detergent from remaining in a detergent supply device.

The present disclosure is directed to providing a washing machine having a detergent supply device with improved usability.

The present disclosure is directed to providing a washing machine having a detergent supply device with improved detergent dissolving performance.

According to a washing machine of the present disclosure, because a water supply nozzle is provided to supply water toward the front from the rear of a case, a detergent can be prevented from remaining in a detergent supply device.

According to the washing machine of the present disclosure, because a detergent container is detachably mounted in the case, usability can be improved.

According to the washing machine of the present disclosure, because a stirring member is provided in the detergent supply device, detergent dissolving performance can be improved.

Hereinafter, embodiments of the present disclosure will be described in detail with reference to the accompanying drawings.

Figure 2:
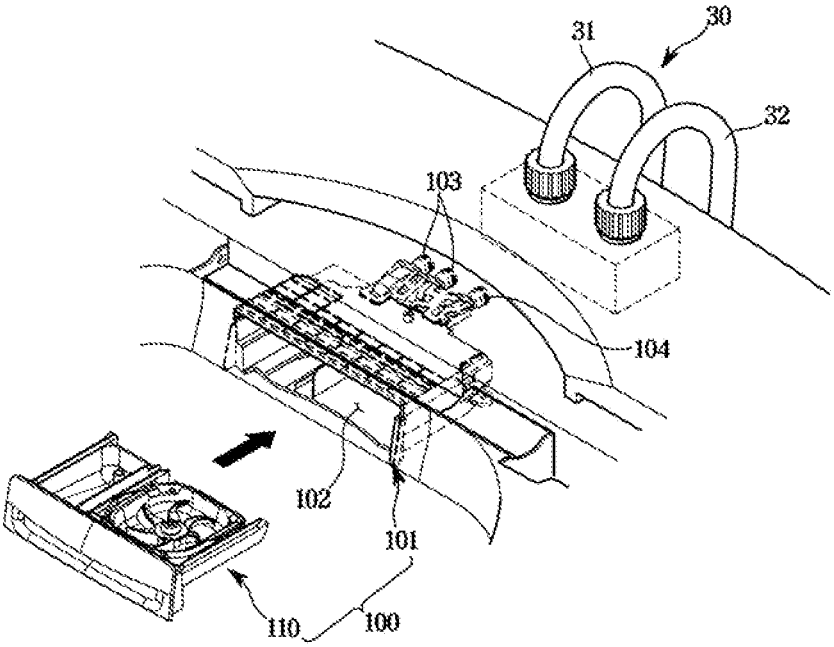
FIG. 2 is a view illustrating a state in which a detergent supply device of the washing machine illustrated in FIG. 1 is drawn out from the washing machine according to an embodiment of the present disclosure.

FIG. 1 is a view illustrating a washing machine according to an embodiment of the present disclosure. FIG. 2 is a view illustrating a state in which a detergent supply device of the washing machine illustrated in FIG. 1 is drawn out from the washing machine.

As illustrated in FIG. 1, a washing machine 1 according to an embodiment of the present disclosure includes a cabinet 10 forming an exterior, a tub 20 installed inside the cabinet 10 to contain water, and a drum 11 rotatably installed inside the tub 20.

The washing machine 1 also includes a water supply device 30 provided to supply water into the cabinet 10, and a detergent supply device 100 configured to contain a detergent and to mix water supplied from the water supply device 30 with the detergent to supply the mixed water to the tub 20.

An opening 12 is formed on an upper side of the cabinet 10 for entry and exit of laundry, and an openable upper cover 13 is installed on the opening 12. An operation panel 14 provided with a plurality of operation buttons and a display unit displaying an operation state is installed on an upper front side of the cabinet 10 so that a user may control an operation of the washing machine.

A tub 20 provided to contain water and a drum 11 provided to rotate inside the tub 20 are installed inside the cabinet 10, and a pulsator 16 is installed on an inner lower side of the drum 11 to generate washing flow.

A driving device (not shown) for driving the drum 11 and the pulsator 16 and a drainage device 15 for draining water are provided below the tub 20 inside the cabinet 10.

In the washing machine 1, water containing the detergent is filled in the tub 20, laundry is put into the drum 11, and then the pulsator 16 is repeatedly rotated in forward and reverse directions by the driving device (not shown), thereby performing washing.

After the washing operation, rinsing of the laundry is performed through the same operation as the above-described washing operation while water is repeatedly supplied and drained, and after the rinsing operation, drainage is performed through the drainage device 15. Also, after the drainage operation, dewatering of the laundry is performed while the drum 11 rotates at a high speed.

The water supply device 30 is installed on a rear upper side of the cabinet 10. The water supply device 30 may include first water supply pipes 31 and 32 extending from a water supply source, water supply valves (not shown) connected to the first water supply pipes 31 and 32 to open and close the first water supply pipe 31, and a plurality of second water supply pipes (not shown) connecting the water supply valves (not shown) and the detergent supply device 100.

The first water supply pipes 31 and 32 include the hot water supply pipe 31 connected to an external hot water supply source and the cold water supply pipe 32 connected to an external cold water supply source. The water supply valves (not shown) may include a hot water supply valve connected to the hot water supply pipe 31 and a cold water supply valve connected to the cold water supply pipe 32. Water may be selectively supplied to either side by a flow path switching operation of the valve.

The detergent supply device 100 may include a housing 101 coupled to the inside of the cabinet 10, and a case 110 accommodated in the housing 101 and containing the detergent therein.

Figure 3:
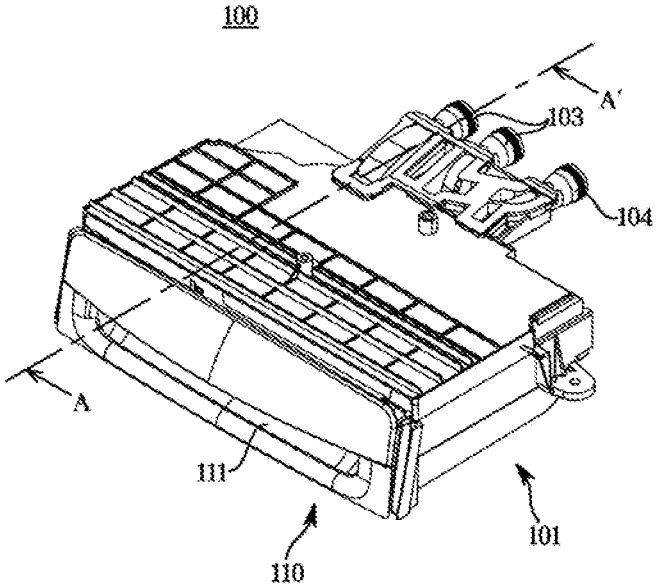
FIG. 3 is a view illustrating the detergent supply device illustrated in FIGS. 1 and 2 according to an embodiment of the present disclosure.
Figure 4:
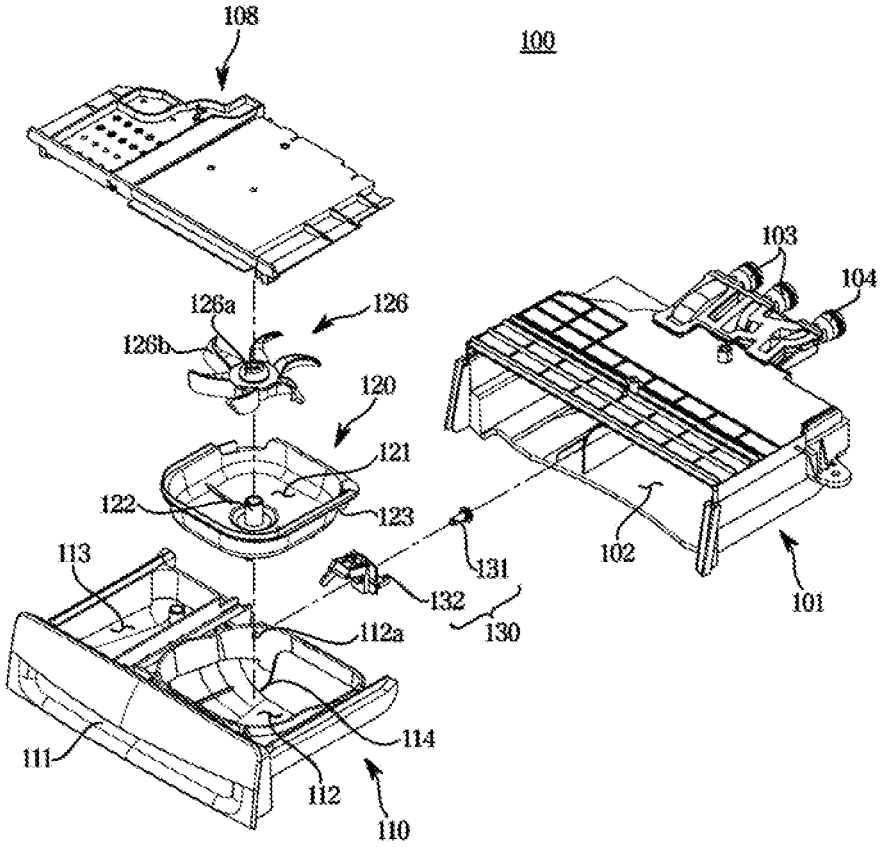
FIG. 4 is an exploded view of the detergent supply device illustrated in FIG. 3 according to an embodiment of the present disclosure.
Figure 5:
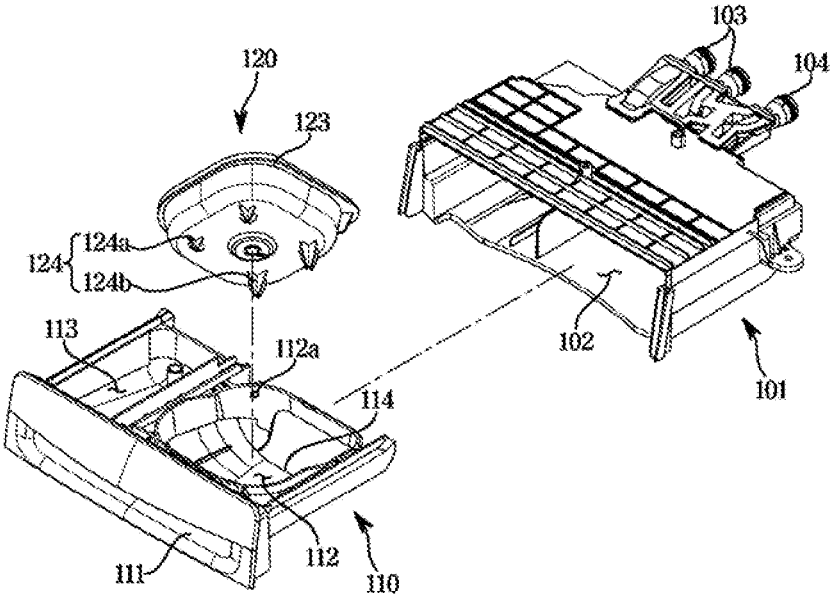
FIG. 5 is a view illustrating a state in which a detergent container is separated from a case illustrated in FIG. 4 according to an embodiment of the present disclosure.

FIG. 3 is a view illustrating the detergent supply device illustrated in FIGS. 1 and 2. FIG. 4 is an exploded view of the detergent supply device illustrated in FIG. 3. FIG. 5 is a view illustrating a state in which a detergent container is separated from the case illustrated in FIG. 4.

Referring to FIGS. 3 and 4, the detergent supply device 100 may include the housing 101 coupled to the cabinet 10. The housing 101 has an open front, and may accommodate the case 110 by providing a case accommodating space 102 therein.

A water supply hose 103 may be provided on a rear surface of the housing 101. The water supply hose 103 may be connected to a water supply pipe 50. In addition to the water supply hose 103, a discharge hose 104 capable of discharging water overflowing from the case 110 may be provided at the rear of the housing 101. Referring to FIGS. 3 and 4, although the detergent supply device 100 according to an embodiment of the present disclosure is illustrated as having the two water supply hoses 103 and the one discharge hose 104, the number of the water supply hoses 103 and the discharge hoses 104 is not limited thereto.

A guide cover 108 configured to cover an upper surface of the case 110 may be coupled to the inside of the housing 101. The guide cover 108 may be fixed to the inside of the housing 101 to guide a moving direction of the water introduced into the case 110. The guide cover 108 is coupled to an upper side of the housing 101, so that when the case 110 is drawn out, the guide cover 108 is not drawn out along with the case 110.

The detergent supply device 100 may include the case 110 provided to be accommodated in the housing 101. The detergent may be contained inside the case 110. The case 110 may be detachably mounted in the housing 101. The case 110 may be inserted into or drawn out from the housing 101. According to this configuration, the user may withdraw the case 110 and fill the case 110 with detergent, as needed.

A grip part 111 may be provided on a front surface of the case 110 so that the user may withdraw the case 110. The case 110 may include a detergent containing space 112 provided to contain a detergent and a softener containing space 113 provided to contain a fabric softener.

A water supply hole 112*a* provided to allow water to be supplied to the inside of the case 110 may be provided on a rear surface of the case 110. The water supply hole 112*a* may be connected to a nozzle device 130. The water supply hole 112*a* may be connected to the water supply hose 103 through the nozzle device 130.

A case outlet 114 may be provided on a bottom surface of the case 110. The case outlet 114 may be positioned at the rear of the bottom surface of the case 110. The bottom surface of the case 110 may be formed to be inclined downward toward the rear thereof. The bottom surface of the case 110 may be formed to be inclined downward toward the case outlet 114. The detergent present in the detergent containing space 112 of the case 110 may be discharged to a connection pipe 54 through the case outlet 114. The detergent discharged to the connection pipe 54 may be supplied to the inside of the tub 20.

In the detergent containing space 112, the detergent may be filled, or the detergent container 120 may be seated. The user may mount and use the detergent container 120 in the detergent containing space 112 as needed.

The detergent container 120 may be detachably mounted in the case 110. The detergent container 120 may include a container containing space 121 formed to contain the detergent. The detergent container 120 may be formed to correspond to the detergent containing space 112 of the case 110.

The detergent container 120 may include a guide rib 123 protruding outward along an edge thereof. The guide rib 123 may be formed on at least a portion of the edge of the detergent container 120. When the detergent container 120 is mounted in the case 110, the guide rib 123 may be provided to be supported on an inner wall forming the detergent containing space 112 of the case 110. According to this configuration, when the detergent container 120 is mounted in the case 110, movement of the detergent container 120 in a lateral direction may be restricted.

Referring to FIG. 5, the detergent container 120 may include a guide protrusion 124 protruding downward from a bottom surface thereof. The guide protrusion 124 may include a first guide protrusion 124*a* and a second guide protrusion 124*b* formed to be longer than the first guide protrusion 124*a*.

The guide protrusion 124 may be provided to be supported on the bottom surface forming the detergent containing space 112 of the case 110 when the detergent container 120 is coupled to the case 110. The guide protrusion 124 may include the first guide protrusion 124*a* and the second guide protrusion 124*b* formed to have different lengths so that the detergent container 120 may be mounted in a correct position in the case 110. Although the case bottom surface 110*a* of the case 110 is formed to be inclined by the guide protrusion 124, a siphon tube 122 may be disposed in the detergent container 120 to extend substantially in a vertical direction.

The bottom surface forming the detergent containing space 112 of the case 110 may be formed to be inclined downward toward the rear. Accordingly, the detergent and/or water present in the detergent containing space 112 may be discharged from the detergent supply device 100 through the case outlet 114 formed at the rear of the case bottom surface 110*a* of the case 110 forming the detergent containing space 112. The case bottom surface 110*a* may be inclined downward toward the case outlet 114.

In order to correspond to the bottom surface forming the detergent containing space 112 of the case 110, the first guide protrusion 124*a* positioned in front of the bottom surface of the detergent container 120 may be formed to be shorter than the second guide protrusion 124*b* positioned in the rear of the bottom surface of the detergent container 120. According to this configuration, the detergent container 120 may be guided to be mounted in the correct position in the case 110.

According to the configuration as described above, because in the detergent water supply device 100 according to an embodiment of the present disclosure, the detergent container 120 may be easily mounted and used in the case 110 depending on the type of the detergent and/or the timing to add the detergent, usability may be improved. In addition, in the detergent supply device 100 according to an embodiment of the present disclosure, the detergent container 120 may be prevented from being mounted in a wrong position in the case 110.

A stirring device 126 may be provided in the detergent container 120 to dissolve the detergent in water. The stirring device 126 may be rotatably provided in at least one portion of a path along which the detergent moves.

The stirring device 126 may be coupled in the container containing space 121 of the detergent container 120. The stirring device 126 may be rotatably coupled to the detergent container 120. The siphon tube 122 may be provided on a bottom surface of the container containing space 121, at least a portion of which protrudes upward to form at least one flow path therein. The stirring device 126 may be coupled to the siphon tube 122. The siphon tube 122 may have a substantially cylindrical shape.

The stirring device 126 may include a coupling part 126*a* coupled to the siphon tube 122, and a plurality of blades 126*b* provided to extend from the coupling part 126*a* to rotate in the container containing space 121.

The siphon tube 122 may be formed to be lower than a height of four side walls forming the container containing space 121 of the detergent container 120. Accordingly, a liquid in the container containing space 121 may first be discharged through the siphon tube 122 except for a case where the liquid overflows beyond the height of the side walls forming the container containing space 121. The siphon tube 122 may form a flow path 127 for draining water from the detergent container 120 together with the stirring device 126.

The detergent container 120 may include a bottom surface 120*a* having a portion inclined downward toward the siphon tube 122.

The nozzle device 130 may be provided on the rear surface of the case 110 to supply water to the inside of the case 110 by mixing water and air. The nozzle device 130 may be disposed to supply water toward the front from the rear of the case 110. The nozzle device 130 may include a nozzle 131 provided to inject water into the case 110, and a nozzle bracket 132 to which the nozzle 131 is mounted.

Figure 6:
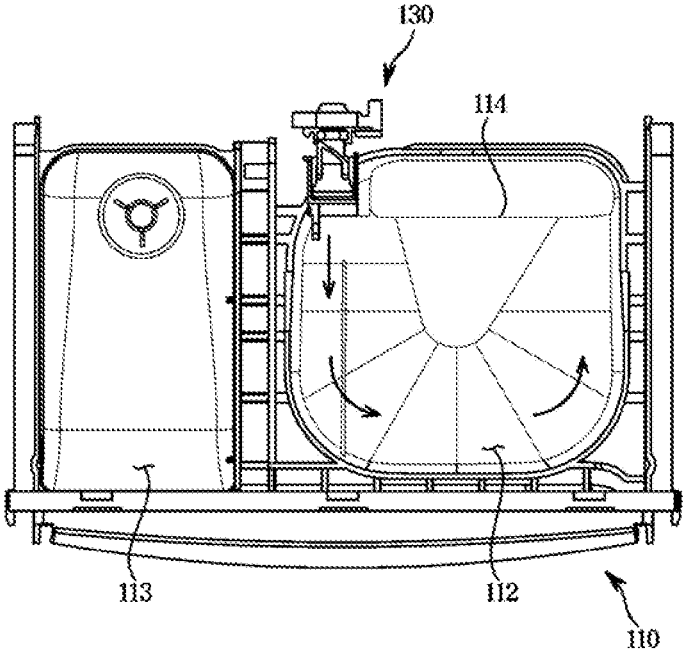
FIG. 6 is a plan view illustrating a state in which the detergent container is separated from the case illustrated in FIG. 4 according to an embodiment of the present disclosure.
Figure 7:
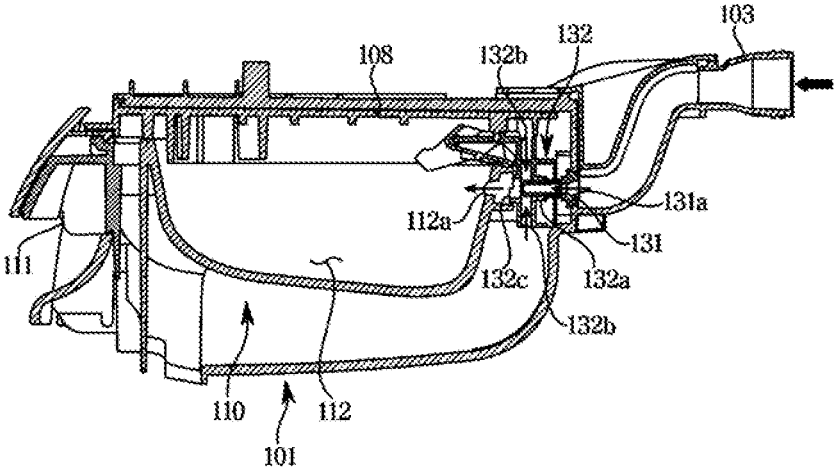
FIG. 7 is a cross-sectional view taken along a line A-A" shown in FIG. 3 according to an embodiment of the present disclosure.
Figure 8:
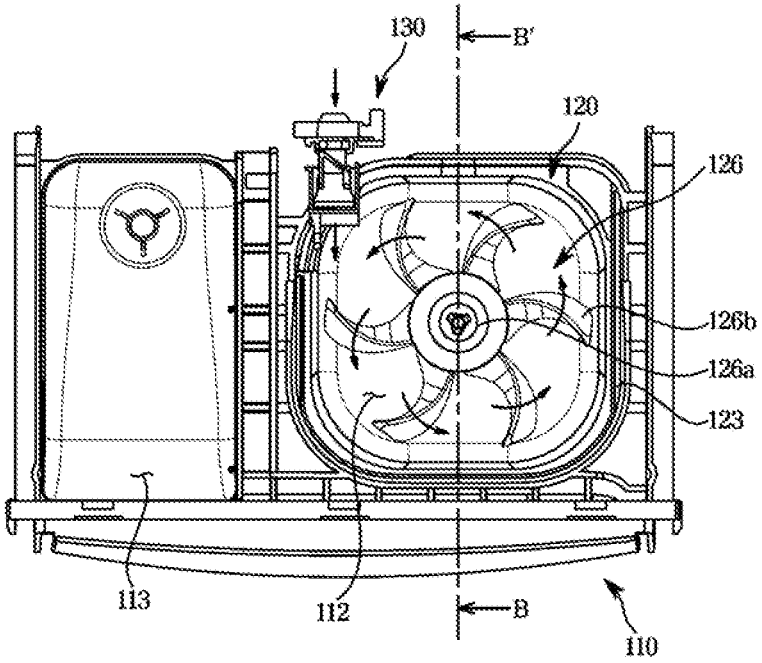
FIG. 8 is a plan view illustrating a state in which the detergent container is mounted in the case illustrated in FIG. 4 according to an embodiment of the present disclosure.
Figure 9:
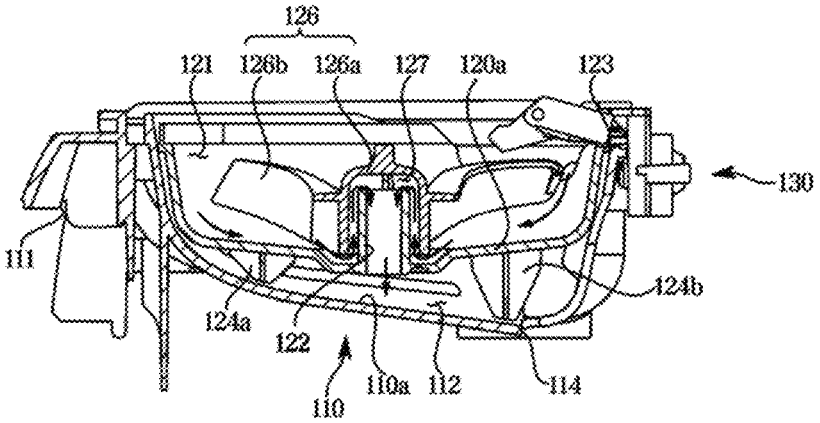
FIG. 9 is a cross-sectional view taken along a line B-B' shown in FIG. 8 according to an embodiment of the present disclosure.

FIG. 6 is a plan view illustrating a state in which the detergent container is separated from the case illustrated in FIG. 4. FIG. 7 is a cross-sectional view taken along a line A-A' shown in FIG. 3. FIG. 8 is a plan view illustrating a state in which the detergent container is mounted in the case illustrated in FIG. 4. FIG. 9 is a cross-sectional view taken along a line B-B' shown in FIG. 8.

Referring to FIGS. 4 to 7, the nozzle 131 may include a washing water inlet hole 131*a* communicating with the water supply hose 103 so that the water is introduced therein. The nozzle 131 may be connected to the water supply hose 103.

The nozzle bracket 132 may be coupled to the case 110 to be connected to the water supply hole 112*a*. The nozzle bracket 132 may include a nozzle coupling part 132*a* to which the nozzle 131 is coupled. The nozzle bracket 132 may include an air inlet hole 132*b* into which air is introduced. The air inlet hole 132*b* may be provided on each of upper and lower sides of the nozzle 131 in a substantially vertical direction. However, the number and/or position of the air inlet holes 132*b* is not limited thereto.

According to this configuration, the air introduced through the air inlet hole 132*b* may meet and mix with the water introduced through the washing water inlet hole 131*a*. The water and air mixed through the washing water inlet hole 131*a* and the air inlet hole 132*b* may be introduced into the case 110 by passing through the water supply hole 112*a* through a nozzle outlet 132*c*.

According to an embodiment of the present disclosure, the washing water inlet hole 131*a* may include a portion whose cross-sectional area decreases toward the air inlet hole 132*b*. Accordingly, a pressure of the water is reduced in the portion of the nozzle device 130 adjacent to the air inlet hole 132*b*, and air may be smoothly introduced through the air inlet hole 132*b*.

The nozzle device 130 may be disposed to be spaced apart from a center of a rear wall of the case 110 to one side. By the arrangement as above, the nozzle device 130 may rotate the stirring device 126. The nozzle device 130 may be positioned on the other side opposite to one side of the rear of the case 110 where the case outlet 114 is positioned so that the water supplied may be discharged through the case outlet 114 after circulating through inner side walls of the case 110.

Because water and air are mixed and supplied to the inside of the case 110 through the nozzle device 130, detergent dissolution efficiency of the detergent supply device 100 can be increased.

Referring to FIGS. 6 and 7, water may be introduced through the water supply hose 103 in a state in which the case 110 is accommodated in the housing 101. The introduced water may pass through the nozzle device 130 and be introduced into the detergent containing space 112. The introduced water forms rotational vortexes in the detergent containing space 112 and dissolves the detergent inside the detergent containing space 112. According to an embodiment of the present disclosure, the water is directly injected by the nozzle device 130 coupled to a rear surface of the detergent containing space 112, and accordingly, the water may be rotated and circulated along the sides forming the detergent containing space 112.

Referring to FIGS. 8 and 9, the detergent supply device 100 may be used by mounting the detergent container 120 in the case 110. In a state in which the case 110 in which the detergent container 120 is mounted is accommodated in the housing 101, water may be introduced through the water supply hose 103. The introduced water may pass through the nozzle device 130 and be introduced into the container containing space 121. The introduced water forms rotational vortexes in the container containing space 121 and dissolves the detergent inside the container containing space 121. In particular, because the water is mixed with air by the nozzle device 130, the dissolution of the detergent may be accelerated.

According to an embodiment of the present disclosure, water is directly injected by the nozzle device 130 coupled to the rear surface of the container containing space 121, and thus the water may be rotated and circulated along the sides forming the container containing space 121. Because the blades 126*b* of the stirring device 126 rotate in this process, the detergent in a solid state may be dissolved.

As the water is supplied to the inside of the container containing space 121, the blades 126*b* of the stirring device 126 may rotate due to the water pressure and rotational vortexes generated when water is injected from the nozzle device 130. Accordingly, a water stream may be formed in the container containing space 121 to more effectively dissolve the detergent. In particular, when lumps of the detergent in the solid state are contained in the container containing space 121, the lumps of the detergent in the solid state remaining in at least a portion of the inside of the container containing space 121 may be pulverized and dissolved.

When the detergent supply device 100 according to an embodiment of the present disclosure is to supply the detergent to the tub 20 after a certain period of time after the washing machine 1 is operated, the detergent container 120 may be mounted in the case 110 and be used. The detergent contained in the detergent container 120 may be dissolved by the stirring device 126 as water is supplied to the detergent supply device 100. Because the detergent dissolved in the water may be supplied to the tub 20 through the siphon tube 122, usability of the detergent supply device 100 according to an embodiment of the present disclosure may be improved.

According to an embodiment of the present disclosure, when water is introduced through the nozzle device 130 and the detergent is dissolved, the water in which the detergent is dissolved may be discharged through the flow path inside the siphon tube 122 to which the stirring device 126 is coupled. The stirring device 126 and the siphon tube 122 may be coupled to be spaced apart from each other to form a flow path through which the water may move between the stirring device 126 and the siphon tube 122.

According to this configuration, because the detergent supply device 100 according to one embodiment of the present disclosure may, even when a liquid detergent is used, dissolve the liquid detergent in water and the dissolved liquid detergent to the tub 20, usability may be improved.

Figure 10:
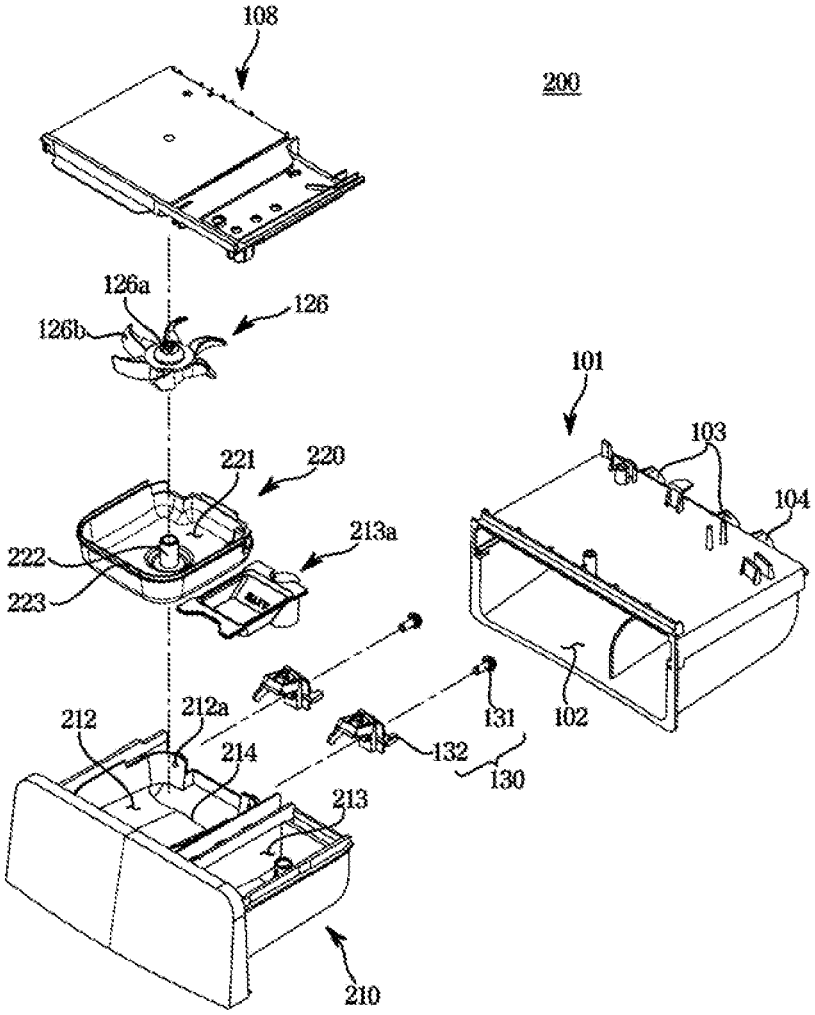
FIG. 10 is a view illustrating a detergent supply device according to another embodiment of the present disclosure according to an embodiment of the present disclosure.

FIG. 10 is a view illustrating a detergent supply device according to another embodiment of the present disclosure.

Hereinafter, a detergent supply device 200 according to another embodiment of the present disclosure will be described with reference to FIG. 10. The same reference numerals are assigned to components identical to those of the detergent supply device 100 illustrated in FIG. 4, and detailed descriptions thereof may be omitted.

Referring to FIG. 10, the detergent supply device 200 according to another embodiment of the present disclosure may include the housing 101 coupled to the cabinet 10, a case 210 provided to be capable of being inserted into the housing 101 or drawn out from the housing 101, a detergent container 220 detachably mounted in the case 210, and the guide cover 108 configured to cover an upper surface of the case 210.

The case 210 may include a water supply hole 212*a* connected to the nozzle device 130. The case 210 may include a case outlet 214 provided to communicate with the tub 20. The case 210 may include a detergent containing space 212 and a softener containing space 213. Comparing the detergent supply device 200 according to the embodiment illustrated in FIG. 10 with the detergent supply device 100 according to the embodiment illustrated in FIG. 4, positions of the detergent containing space 212 and the softener containing space 213 of the detergent supply device 200 are opposite to those of the detergent supply device 100, and the other components may be identically provided.

The detergent container 220 may be detachably mounted in the detergent containing space 212. The detergent container 220 may include a container containing space 221 and a siphon tube 222. The detergent container 220 may include a guide rib 223 protruding such that movement of the detergent container 220 in a lateral direction is restricted when mounted in the case 210.

A softener guide 213*a* may be mounted in the softener containing space 213. The softener guide 213*a* may guide the softener filled in the softener containing space 213 to the tub 20.

Figure 11:
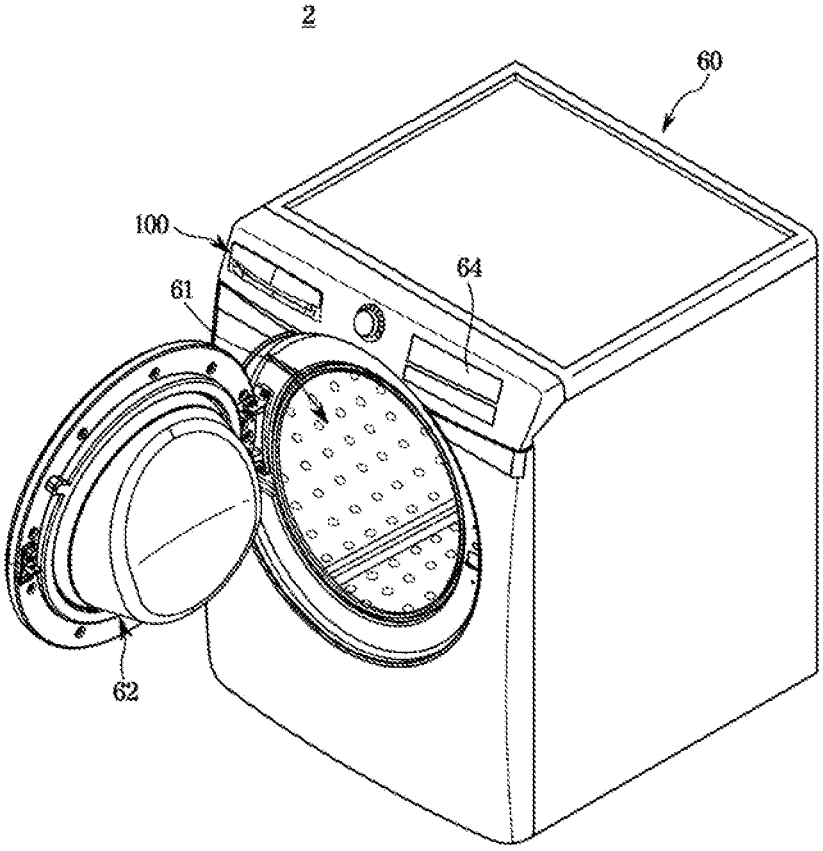
FIG. 11 is a view illustrating a washing machine according to another embodiment of the present disclosure according to an embodiment of the present disclosure.
Figure 12:
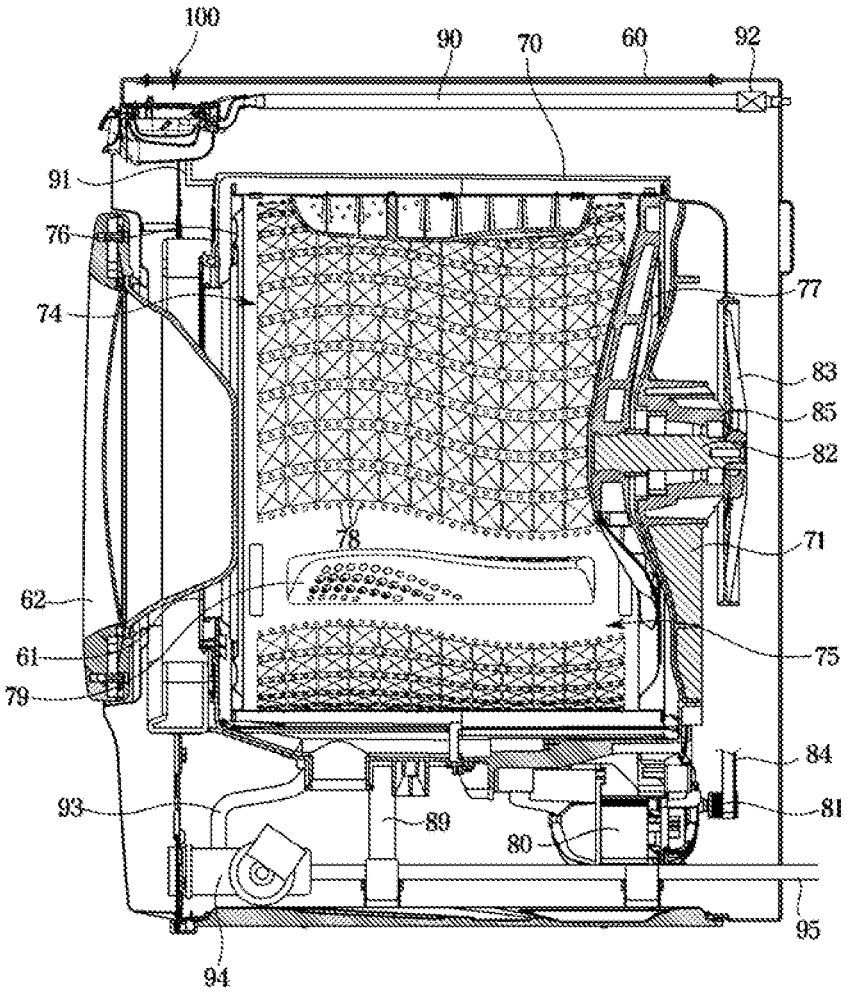
FIG. 12 is a side cross-sectional view of the washing machine illustrated in FIG. 11 according to an embodiment of the present disclosure.

FIG. 11 is a view illustrating a washing machine according to another embodiment of the present disclosure. FIG. 12 is a side cross-sectional view of the washing machine illustrated in FIG. 11.

Hereinafter, a washing machine 2 according to another embodiment of the present disclosure will be described with reference to FIGS. 11 and 12. The same reference numerals are assigned to components identical to those of the washing machine 1 illustrated in FIGS. 1 and 2, and detailed descriptions thereof may be omitted. Specifically, the detergent supply device 100 illustrated in FIGS. 1 and 2 may be applied not only to the fully automatic washing machine 1 illustrated in FIGS. 1 and 2 but also to a drum washing machine 2 illustrated in FIGS. 11 and 12.

As illustrated in FIGS. 11 and 12, the washing machine 2 includes a cabinet 60 forming an exterior, a tub 70 disposed inside the cabinet 60, a drum 74 rotatably disposed inside the tub 70, and a driving motor 80 provided to drive the drum 74.

An opening 61 is formed on a front side of the cabinet 60 so that laundry may be put into the drum 74. The opening 61 is opened and closed by a door 62 installed on the front side of the cabinet 60.

A water supply pipe 90 provided to supply water to the tub 70 is installed above the tub 70. One side of the water supply pipe 90 is connected to a water supply valve 92, and the other side of the water supply pipe 90 is connected to the detergent supply device 100. The detergent supply device 100 is connected to the tub 70 through a connection pipe 91. Water supplied through the water supply pipe 90 is supplied into the tub 70 together with a detergent via the detergent supply device 100.

The tub 70 is supported by a damper 89. The damper 89 connects an inner bottom surface of the cabinet 60 and an outer surface of the tub 70.

The drum 74 includes a cylindrical part 75, a front plate 76 disposed in front of the cylindrical part 75, and a rear plate 77 disposed in the rear of the cylindrical part 75. An opening for entering and exiting laundry is formed on the front plate 76, and a shaft 82 provided to transmit power of the driving motor 80 is connected to the rear plate 77.

A plurality of passing holes 78 for passing water is formed on a circumference of the drum 74, and a plurality of lifters 79 is installed on an inner circumferential surface of the drum 74 to allow laundry to rise and fall when the drum 74 rotates.

The drum 74 and the driving motor 80 are connected through the shaft 82, and the connection form between the shaft 82 and the driving motor 80 may be classified into a direct drive type in which the shaft 82 is directly connected to the driving motor 80 to rotate the drum 74, and an indirect drive type in which the drum 74 is driven by connecting a shaft pulley 83 connecting the driving motor 80 and the shaft 82.

The washing machine 2 according to another embodiment of the present disclosure may be provided as the indirect drive type, but is not limited thereto, and the technical features of the present disclosure are also applicable to the direct drive type.

One end of the shaft 82 is connected to the rear plate 77 of the drum 74, and the other end of the shaft 82 extends to the outside of a rear part 71 of the tub 70. The other end of the shaft 82 may be inserted into the shaft pulley 83 to obtain a driving force from the driving motor 80. A motor pulley 81 is formed on a rotating shaft of the driving motor 80. A drive belt 84 is provided between the motor pulley 81 and the shaft pulley 83 so that the shaft 82 may be driven by the drive belt 84.

The driving motor 80 is disposed on one side of a lower portion of the tub 70 to drive the shaft 82 while the drive belt 84 rotates clockwise or counterclockwise in a vertical direction of the tub 70.

A bearing housing 85 is installed on the rear part 71 of the tub 70 to rotatably support the shaft 82. The bearing housing 85 may be made of an aluminum alloy, and may be inserted into the rear part 71 of the tub 70 when the tub 70 is injection molded.

A drain pump 94 provided to discharge water inside the tub 70 to the outside of the cabinet 60, a connection hose 93 connecting the tub 70 and the drain pump 94 so that water inside the tub 70 may be introduced into the drain pump 94, and a drain hose 95 guiding the water pumped by the drain pump 94 to the outside of the cabinet 60 are provided below the tub 70.

A display unit 64 for displaying a state of the washing machine 2 for a user may be provided at an upper portion of a front surface of the cabinet 60. The display unit 64 may also include an input part. A printed circuit board assembly (not shown) may be provided at the upper portion of the front surface of the cabinet 60.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

What is claimed is:

1. A washing machine comprising:

a cabinet;

a tub arrangeable inside the cabinet; and a detergent supply device configured to supply a detergent to the tub, wherein the detergent supply device comprises:

a housing coupleable to the cabinet;

a case, insertable into the housing or drawn out from the housing, the case including a case outlet to discharge the detergent from the detergent supply device toward the tub and the case having a bottom surface inclined toward the case outlet; and a detergent container including a first guide protrusion disposed at a front side of a bottom surface thereof, a second guide protrusion, which are spaced apart from the first guide protrusion, disposed at a rear side of the bottom surface thereof and having longer lengths than a length of the first guide protrusion protruding toward the bottom surface of the case, and a siphon tube disposed at a central portion thereof protruding upward, the detergent container being coupleable to and decoupleable from the case such that while the detergent container is coupled to the case, the detergent container is supported on the bottom surface of the case that is inclined toward the case outlet, the detergent container is insertable into the housing or drawn out from the housing along with the case, wherein the bottom surface of the detergent container has a portion inclined downward toward the siphon tube.

2. The washing machine according to claim 1, wherein the detergent supply device comprises a stirring device coupleable to the detergent container such that the stirring device is rotatable while coupled to the detergent container.

3. The washing machine according to claim 2, wherein the stirring device is coupleable to the siphon tube such that the stirring device is rotatable while coupled to the siphon tube, and the siphon tube forms a flow path to discharge water from the detergent container together with the stirring device.

4. The washing machine according to claim 3, wherein the siphon tube has a height lower than a side wall of the detergent container.

5. The washing machine according to claim 2, wherein the stirring device is rotatable by water supplied to the detergent supply device.

6. The washing machine according to claim 1, wherein the detergent supply device comprises a nozzle device to supply water from a rear of the case toward a front of the case.

7. The washing machine according to claim 6, wherein the nozzle device comprises:

a washing water inlet hole into which water is introduced;

an air inlet hole into which air is introduced; and a nozzle outlet to guide the water introduced through the washing water inlet hole to an inside of the case.

8. The washing machine according to claim 6, wherein the nozzle device is disposed to be spaced apart from a center of a rear wall of the case to one side.

9. The washing machine according to claim 6, wherein the nozzle device is positioned on another side opposite to one side of the rear of the case where the case outlet is positioned.

10. The washing machine according to claim 1, wherein the detergent container comprises a guide rib protruding from an outer surface thereof to be supported by an inner wall of the case while the detergent container is coupled to the case.

11. The washing machine according to claim 1, wherein the case comprises a detergent containing space to contain the detergent or to seat the detergent container.

12. The washing machine according to claim 1, wherein the case comprises a detergent containing space and a softener containing space separated from the detergent containing space, and the detergent container is coupleable to and decoupleable from the detergent containing space.

* * * * *